US006347752B1

(12) United States Patent
Davidson et al.

(10) Patent No.: US 6,347,752 B1
(45) Date of Patent: Feb. 19, 2002

(54) FOAM SPRAY GUN NOZZLE EXTENSION ASSEMBLY

(76) Inventors: James W. Davidson, 2595 Wadsworth Rd., Norton, OH (US) 44203; Robert J. Klein, 16571 Diagonal Rd., LaGrange, OH (US) 44050

( * ) Notice: Subject to any disclaimer, the term of this patent is extended or adjusted under 35 U.S.C. 154(b) by 0 days.

(21) Appl. No.: 09/438,804

(22) Filed: Nov. 12, 1999

(51) Int. Cl.[7] ..... B05B 1/00; B05B 15/06; A62C 31/24

(52) U.S. Cl. ..... 239/600; 239/532; 239/280

(58) Field of Search ..... 239/600, 398, 239/400, 414, 407, 417.5, 428, 532, 525, 587.1, 526, 280, 281, 290, 578

(56) References Cited

U.S. PATENT DOCUMENTS

| | | | | | |
|---|---|---|---|---|---|
| 3,700,174 | A | | 10/1972 | Beck | |
| 3,701,482 | A | | 10/1972 | Sachnik | |
| 3,915,382 | A | | 10/1975 | Davis | |
| 4,412,656 | A | | 11/1983 | Beck | |
| 4,645,009 | A | | 2/1987 | Hawelka et al. | |
| 4,744,519 | A | * | 5/1988 | Crowley | 239/532 |
| 4,805,700 | A | | 2/1989 | Hoover | |
| 5,152,462 | A | | 10/1992 | Evans | |
| 5,271,564 | A | * | 12/1993 | Smith | 239/532 |
| 5,344,074 | A | * | 9/1994 | Spriggs et al. | 239/10 |
| 5,671,889 | A | | 9/1997 | Petty | |
| 5,810,254 | A | | 9/1998 | Kropfield | |
| 6,021,961 | A | * | 2/2000 | Brown | 239/398 |

* cited by examiner

*Primary Examiner*—David A. Scherbel
*Assistant Examiner*—Davis Hwu
(74) *Attorney, Agent, or Firm*—Vickers, Daniels & Young

(57) ABSTRACT

An extension assembly is provided for mounting the nozzle assembly of a polyurethane foam spray gun at a location spaced forwardly of the gun housing for operation of the nozzle assembly to mix and dispense chemical constituents in response to standard operation of the spray gun through the trigger mechanism thereof.

31 Claims, 7 Drawing Sheets

FOAM SPRAY GUN NOZZLE EXTENSION ASSEMBLY

BACKGROUND OF THE INVENTION

This invention relates to the art of applying plastic foams to a substrate and, more particularly, to a nozzle extension assembly for a hand held foam spray gun.

It is of course well known to apply plastic foams, such as polyurethane foams, to a substrate through the use of a hand held foam spray gun such as the Model GX-7 spray gun available from the Gusmer Corporation of Lakewood, N.J. and the Probler spray gun available from Glas-Craft, Inc. of Indianapolis, Ind. Such spray guns include a nozzle assembly to which two liquid chemical components are preheated and pumped at high pressures for mixing and discharge from the nozzle component of the nozzle assembly to produce a plastic foam which is sprayed onto the substrate where the mixture cures in a matter of seconds. A hand operated trigger mechanism in the gun is operable to control the spray discharge and, in the aforementioned guns, air under pressure is supplied to the gun in response to actuation of the trigger mechanism to displace a valving rod so that the chemical components enter and are mixed in a mixing area in a nozzle assembly and then discharged in a spray pattern. In the GX-7 gun, the air is also operable to clean the pattern control disc in the nozzle component and to atomize oversize droplets upon ejection from the nozzle component, and in the Probler gun, the air is used to purge the nozzle component of chemicals following a spray discharge operation.

A considerable number of problems are attendant to the spray application of plastic foams to roof decks, walls, ceilings, and the like through the use of hand operated spray guns of the foregoing character. In particular in connection with the spray application of foams to roof decks, a major problem known as over-spray results from a combination of the distance between the gun nozzle or tip and the surface being sprayed and atmospheric conditions in the area of application. Over-spray results in the loss of foam material which does not get deposited on the roof surface but, rather, becomes airborne and spread over a considerable distance in the vicinity of the roofing project. This over-spray can result in the deposit of particulate foam material on cars, building walls, windows, landscaping and other surrounding structures which are not protected and which can be costly either to protect or to clean after the roofing project is completed.

A further problem in connection with the spray application of plastic foams to roof decks, walls, ceilings, or the like is the health hazard to a person or persons operating the spray guns. In this respect, the atomization of the spray material results in airborne contaminants in the area of application which are a health hazard to the person doing the spray application as well as other persons in the vicinity thereof in that, for example, the inhaling of the contaminants can lead to respiratory problems and/or the exposure of the person's skin and/or eyes to the airborne contaminants can result in skin and/or eye irritation. Again, nearby workers and/or other persons not in the immediate work area are also exposed to the atomized contaminants because of the excessive amount of drifting of the atomized material resulting from the travel distance from the gun tip to the surface being sprayed. In order to reduce such drifting in connection with spraying foam on an underlying surface such as a roof deck, the gun operator must bend over so as to shorten the distance between the gun tip and the roof surface, whereby the operator is working in an uncomfortable position which promotes fatigue and, moreover, positions the operator's hands and face closer to the surface which does not reduce the operator's exposure to the atomized and airborne contaminants. It will be appreciated, of course, that fatigue results in decreased productivity.

In connection with the spray application of foams on vertical walls and/or ceilings, an operator often is required to stand on a ladder or other supporting structure in order to reach the upper extremities of a wall and/or ceiling, thus exposing the operator to potential injury should he or she fall from the supporting structure. Still further, in connection with the spray application of foams to substrates in general, the width of the application area is limited by the extent to which the gun operator can move his or her arm laterally with respect to the direction of the path along which the material is sprayed whereby, in connection with a given width of the surface to which the foam is being applied, multiple passes are required to complete the spray application process.

SUMMARY OF THE INVENTION

In accordance with the present invention, a spray gun nozzle extension assembly is provided by which an operator of a spray gun of the foregoing character can selectively use the latter with the nozzle assembly attached to the gun body or housing or with the nozzle assembly supported at a location spaced from the housing, whereby the operator can stand up and apply foam to a substrate with a desirably short distance between the nozzle tip and the surface being sprayed. More particularly in accordance with the invention, a spray gun nozzle extension assembly is provided which is selectively usable with an existing spray gun, whereby the latter can be used by an operator with the nozzle assembly directly attached to the gun housing or, alternatively, can be used with the nozzle assembly removed from the housing and supported at a location spaced therefrom by a support member having one end attached to the housing through the use of the fasteners for mounting the nozzle assembly thereto and having an opposite end to which the nozzle assembly as a unit can be attached through the use of similar fasteners. The nozzle assembly includes inlets for the two chemical components of the polyurethane foam, and the extension assembly includes a bracket attached to the gun housing and a pair of supply hoses having ends connected to the inlets of the nozzle assembly and ends supported by the bracket at the housing for connection with the source supply lines for the two chemical components. The nozzle extension assembly further includes an operating member between the trigger assembly in the gun housing and the nozzle assembly, whereby operation of the trigger by an operator holding the gun operates in the same manner to control the flow of the two components through the nozzle assembly as when the latter is directly mounted on the gun housing. Still further, the extension assembly includes an air flow line between the gun housing and the nozzle assembly at the outer end of the support member for supplying air in connection with the disc cleaning, atomizing and purging functions associated with operation of the gun.

Advantageously, an operator can mount the nozzle assembly of a gun at a location spaced from the normal mounting thereof, via the extension assembly, and apply foam to an underlying substrate such as a roof deck with a desirable spacing between the nozzle and deck surface without having to bend over, thus avoiding fatigue and other problems attendant to such physical stress. Further, the extension increases the width of deposit of foam along a path by about 50% compared to that obtainable with the nozzle assembly directly mounted on the gun body whereby, when multiple passes are required, the number of passes can be significantly reduced. Still further, with the nozzle assembly mounted on the gun body via the extension assembly, an operator can reach vertically high and/or overhead locations without having to stand on a ladder or the like, thus eliminating the danger of injury through a fall from the ladder. Preferably, the extension assembly provides for supporting the nozzle assembly at a location spaced 18 inches or 24 inches from the gun body, and selection between such dimensions, or other dimensions, provides versatility with respect to providing a desired comfort level for the gun operator during use of the spray gun depending on his or her height. In any event, it will be appreciated that the extension assembly provides for positioning the nozzle of the spray gun at a location relative to an underlying surface which minimizes over-spray and exposure of the operator to atomized material, thus to minimize drifting of the material onto objects and persons in the vicinity of the work area and exposure of the operator to potential health hazards from the chemicals in the atomized materials. All of the foregoing advantages promote increased productivity and promote a higher yield of materials used and improvement in material application.

It is accordingly an outstanding object of the present invention to provide a foam spray gun nozzle extension assembly enabling selective mounting of the nozzle of a foam spray gun directly on the gun housing or at a location spaced forwardly thereof for the mixing and dispensing of foam producing chemicals at the nozzle in response to actuation of the gun trigger on the gun housing.

Another object is the provision of a nozzle extension assembly of the foregoing character which, in connection with the spraying of foam on an underlying substrate, promotes a reduction in over-spray and drifting of atomized chemicals which are potentially hazardous.

A farther object is the provision of a nozzle extension assembly of the foregoing character which promotes a reduction in fatigue of a spray gun operator, an increase in productivity and a higher yield with respect to the sprayed material.

Still a further object is a provision of a nozzle extension assembly of the foregoing character which promotes a reduction of exposure of workers to potentially hazardous chemicals.

Yet another object is the provision of a nozzle extension assembly of the foregoing character by which a foam spray gun is selectively operable with the nozzle on the gun housing or supported a location spaced from the housing and wherein the extension is mountable on the housing through the mounting components for the nozzle and wherein the nozzle is mounted on the extension through like fastening components.

Still another object is the provision of a nozzle extension assembly of the foregoing character which is structurally simple, economical to produce and which provides for the easy and quick conversion of a foam spray gun between gun assemblies in which the nozzle is mounted directly on the gun housing or at a location spaced therefrom.

BRIEF DESCRIPTION OF THE DRAWINGS

The foregoing objects, and others, will in part be obvious and in part pointed our more fully hereinafter in conjunction with the written description of preferred embodiments of the invention illustrated in the accompanying drawings and which.

DESCRIPTION OF PREFERRED EMBODIMENTS

Figure 1:
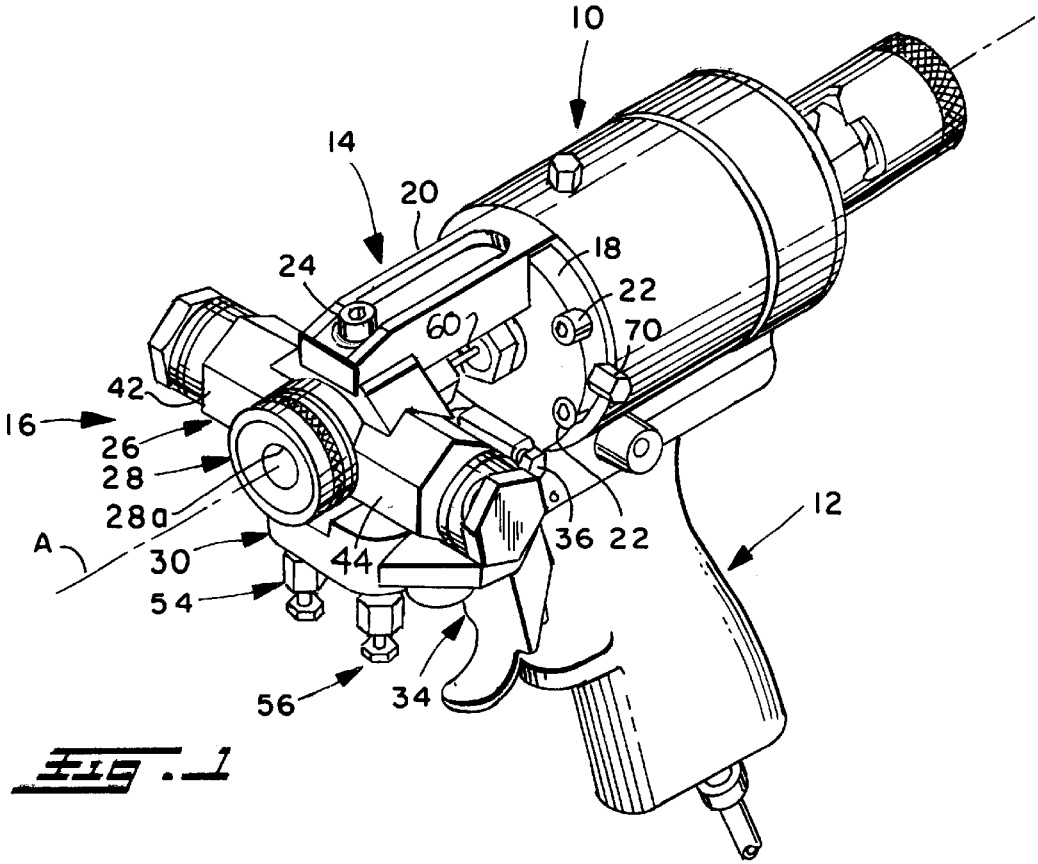
FIG. 1 is a perspective view of a spray gun for which one embodiment of a nozzle extension is provided in accordance with the present invention.
Figure 2:
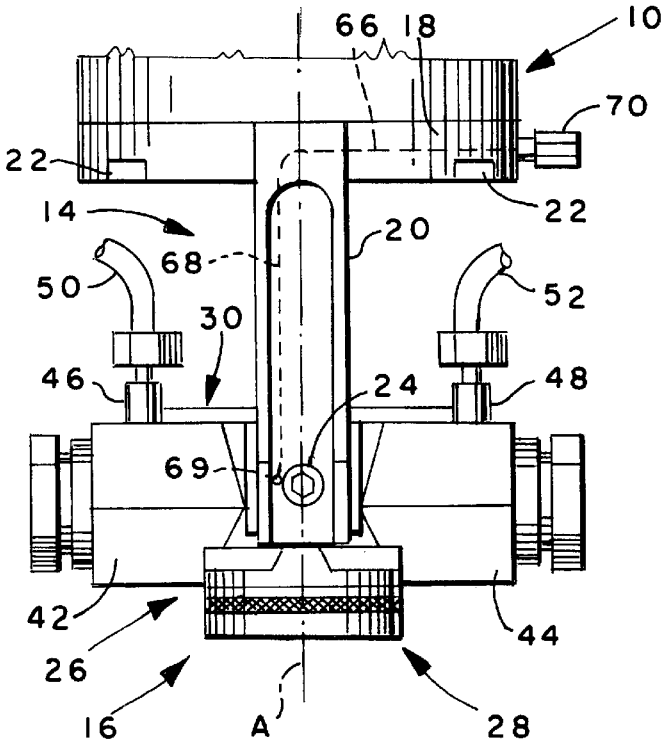
FIG. 2 is a plan view of a portion of the spray gun shown in FIG. 1.
Figure 3:
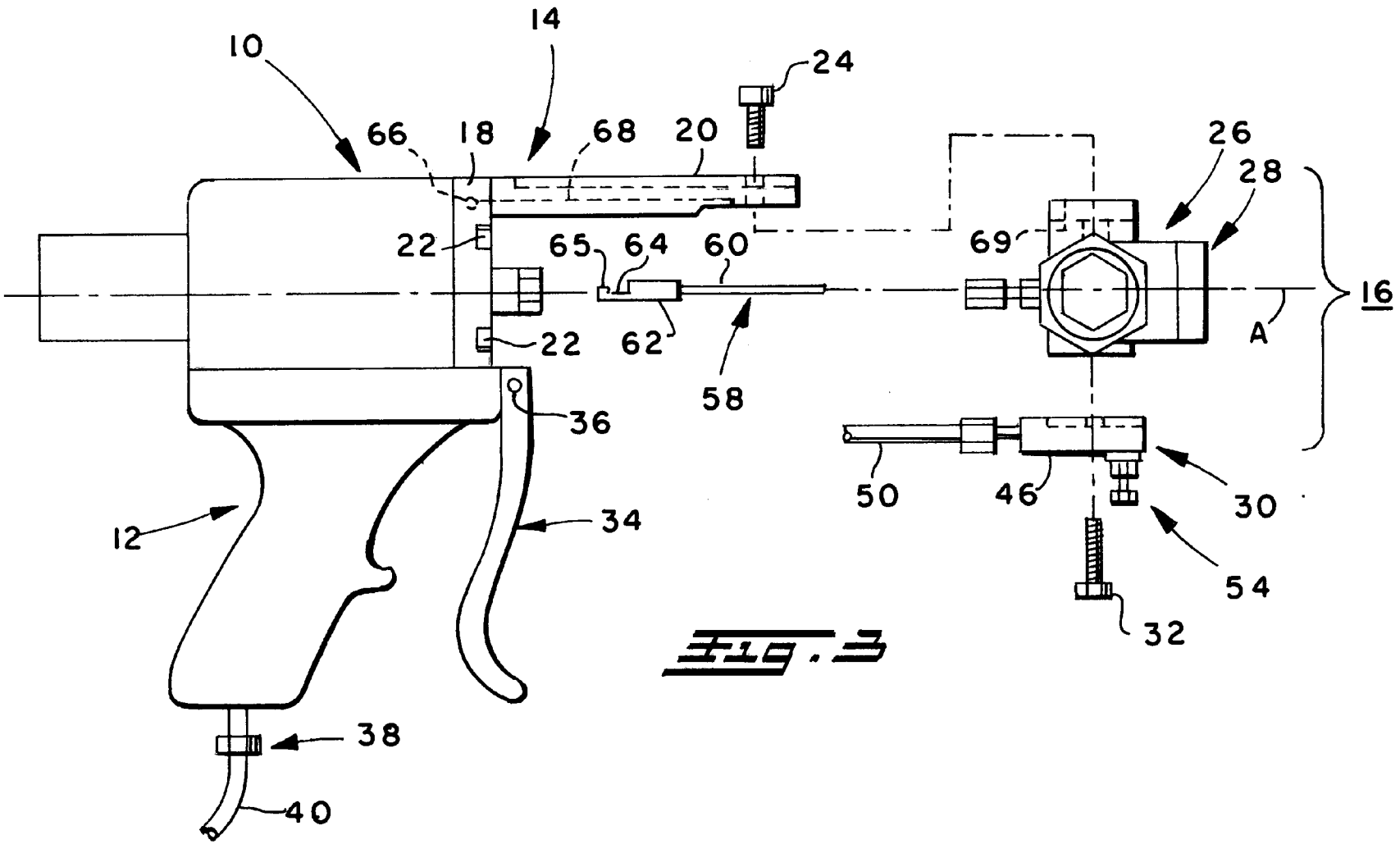
FIG. 3 is an exploded side elevation view of the spray gun looking in the direction from left to right in FIG. 1.

Referring now in greater detail to the drawings, wherein the showings are for the purpose of illustrating preferred embodiments of the invention only and not for the purpose of limiting the invention, FIGS. 1–3 illustrate the Model GX-7 spray gun of Gusmer Corporation referred to hereinabove and which comprises, basically, a gun housing including a body portion 10 having a handle 12, and a nozzle assembly support member 14, and a nozzle assembly 16. The gun has an axis A, and support member 14 includes a circular base 18 and a forwardly extending support bar 20 spaced radially outwardly of axis A at the upper end of base 18. Support member 14 is mounted on body 10 by a plurality of socket head cap screws 22, and nozzle assembly 16 is removably mounted on the axially outer end of bar 20 by a socket head cap screw 24. Nozzle assembly 16 comprises a nozzle and valve unit 26 having a dispensing nozzle 28 coaxial with axis A and having a dispensing outlet 28*a*. The nozzle assembly further includes a coupling block unit 30 secured to the underside of nozzle and valve unit 26 by a socket head cap screw 32. The spray gun further includes a trigger 34 pivotally mounted on the upper end of handle 12 by a pin 36, and a coupling 38 is provided on the bottom of handle 12 for connecting the gun to a source of air under pressure by an airline 40.

As is well known in connection with this spray gun, nozzle and valve unit 26 includes tubular portions 42 and 44 extending laterally outwardly from opposite sides of nozzle 28 and providing chambers in the nozzle and valve unit, each for receiving a different one of the chemical components of the polyurethane foam, and which chambers open laterally inwardly into a mixing area in the nozzle and valve unit for discharge through the nozzle outlet. As is further well known, coupling block unit 30 has inlets 46 and 48 corresponding to tubular portions 42 and 44, respectively, and inlets 46 and 48 are adapted to receive the corresponding chemical component through supply lines 50 and 52 which are coupled with inlets 46 and 48, respectively. Coupling block unit 30 further includes manually operable valves 54 and 56 for controlling the flow of chemicals into the cylinders defined by tubular portions 42 and 44, respectively. As is still further well known in connection with this spray gun, nozzle and valve unit 26 includes a valving rod 58 having an operating end 60 received in nozzle and valve unit 26 coaxial with axis A and which is operable to open and close communication between the chemical component chambers and the mixing area in the nozzle and valve unit. Valving rod 58 further includes an actuating end 62 received in housing 10 and having a notch 64 and flat 65 therein for coupling with a mating notch in a valving rod draw bar in the housing, not shown. The draw bar is displaced axially inwardly of housing 10 by air under pressure in response to pulling trigger 34 toward handle 12 so as to displace operating end 60 of valving rod 58 axially inwardly of the housing to open communication between the chemical component chambers and the mixing area in the nozzle and valve unit. More particularly, when trigger 34 is displaced towards handle 12, air under pressure from line 40 is operable to displace the valving rod draw bar and thus the valving rod in the foregoing manner so as to achieve dispensing of the mixed chemical component. In this spray gun, as will be appreciated from FIGS. 2 and 3, air under pressure is also delivered through a passageway 66 in base 18 and a passageway 68 in support bar of support member 14 to a passageway 69 leading into the nozzle 28 to clean the pattern control disc during spray operation of the gun and to atomize oversize droplets upon ejection thereof from the nozzle. When trigger 34 is released, the air flow ceases and the operating end 60 of valving rod 58 pushes residual chemicals from the nozzle. Air flow to the nozzle from the source under pressure is through the handle 12 and passageway 66 in base 18 of support member 14 and across a needle valve in the latter passageway having an outer end 70 by which the needle valve can be adjusted to control the flow of air from the source to the nozzle.

Figure 4:
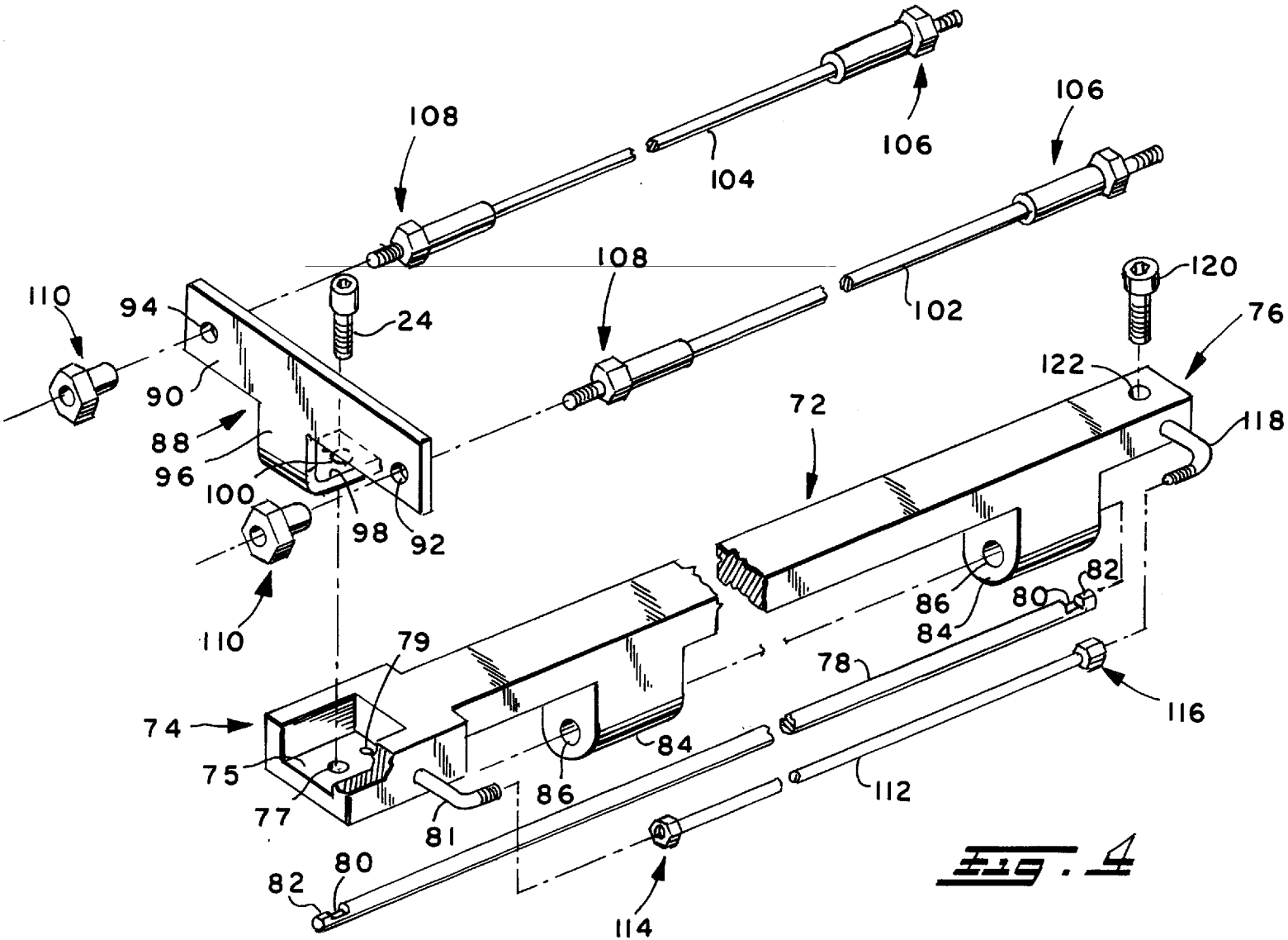
FIG. 4 is an exploded perspective view of the component parts of a nozzle extension assembly for the spray gun shown in FIGS. 1–3.
Figures 5, 5A:
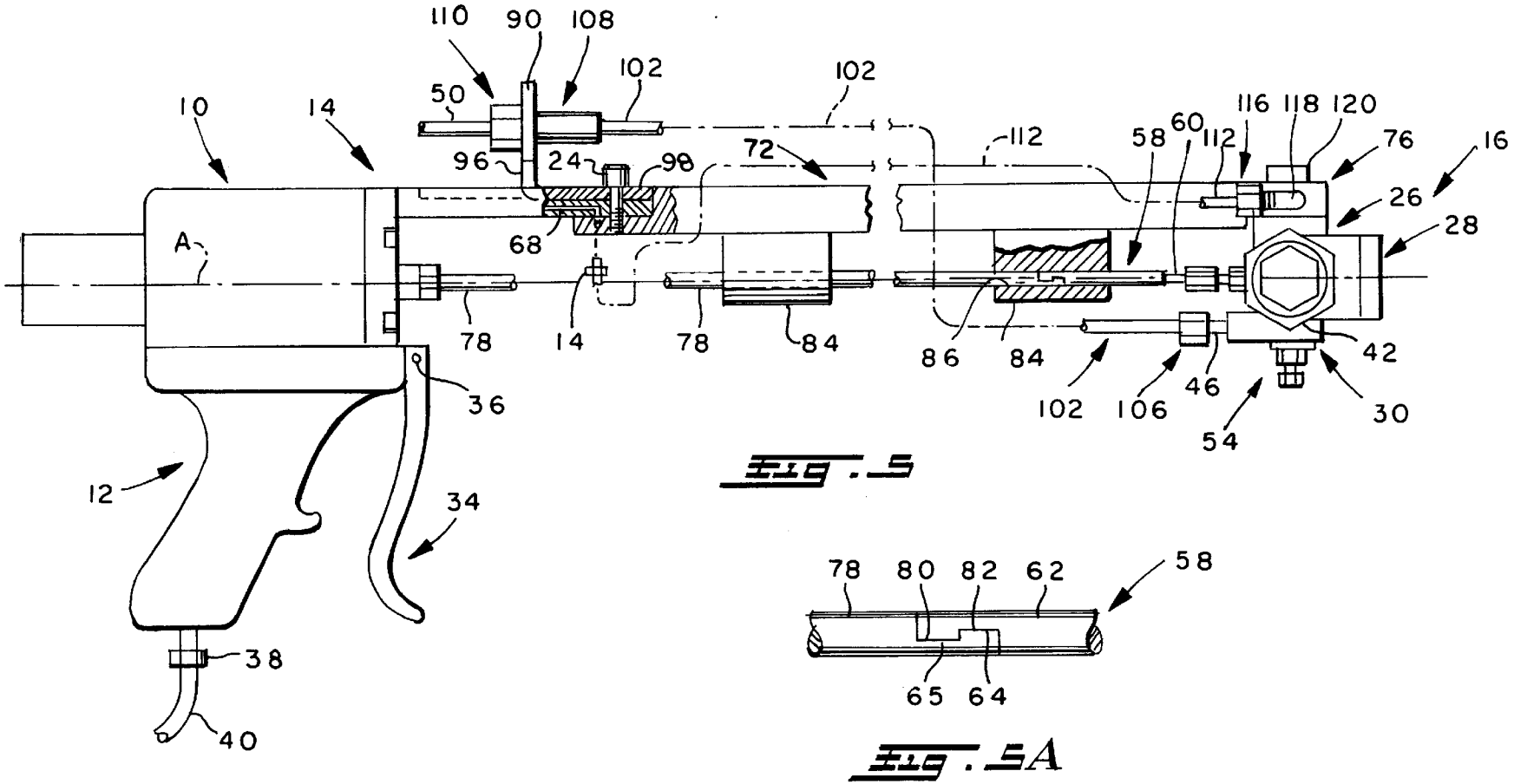
FIG. 5 is a side elevation view, partially in section, showing the extension assembly mounted between the spray gun body and nozzle assembly.
FIG. 5A is a detailed view showing the coupling arrangement between the operating rod of the extension assembly and the valving rod of the nozzle assembly.

FIG. 4 illustrates the component parts of an extension assembly by which nozzle assembly 16 is adapted to be mounted on the gun housing at a location spaced forwardly of the mounting thereof on support member 14 of the housing, and FIG. 5 illustrates the nozzle assembly so mounted on the gun housing. With reference first to FIG. 4, the extension assembly comprises an elongate support member 72 having an inner end 74 and an outer end 76 for respectively mounting the support member on the gun housing and the nozzle assembly on the support member as set forth more fully hereinafter. In part in this respect, inner end 74 of support member 72 is provided with a recess 75 having a threaded opening 77 in the bottom wall thereof and which recess and opening facilitate mounting of support member 72 on the outer end of arm 20 of support member 14 of the spray gun housing as set forth more fully hereinafter. For the purpose set forth hereinafter, inner end 74 of the support member is provided with a passageway 79 having an entrance end aligned with the outlet end of passageway 68 in bar 20 of support member 14 and having an outlet end defined by an externally threaded tap 81 on the side of support member 72 adjacent inner end 74 thereof. The extension assembly further includes an actuating member 78 in the form of a circular rod having opposite ends provided with a notch 80 and flat 82 for the purpose set forth hereinafter, and support member 72 is provided with depending support and guide components 84 spaced apart along the length thereof and having passageways 86 therethrough for receiving and slidably supporting rod 78. The extension assembly further includes a T-shaped support bracket 88 which, in the orientation shown in FIG. 4, has a horizontally extending cross member 90 provided with openings 92 and 94 through the laterally opposite ends thereof and a mounting leg intermediate the opposite ends of the cross member and including a vertical portion 96 and a horizontal portion 98 extending forwardly thereof and provided with an opening 100 by which the bracket is mounted on the gun housing as set forth hereinafter. The extension assembly further includes a pair of chemical supply conduits 102 and 104 for respectively supplying a chemical component to inlets 46 and 48 of nozzle and valve unit 26. Conduits 102 and 104 are, preferably, rubber hoses or the like, and each of the conduits has a first end 106 provided with a coupling for connection to the corresponding inlet. Each of the conduits has a second end 108 including a coupling component by which the corresponding conduit is adapted to be supported on bracket 90. More particularly in this respect, the coupling components have threaded ends adapted to extend through a corresponding one of the openings 92 and 94 in bracket 88 and to receive internally threaded coupling components 110 by which the ends of conduits 102 and 104 are secured to mounting bracket 88 for connection to the corresponding one of the chemical component supplies. The extension assembly further includes an air conduit 112 for supplying air under pressure to the nozzle assembly when the latter is mounted on outer end 76 of support member 72. Conduit 112 is preferably a rubber hose or the like and is provided on one end with a coupling 114 for connecting the conduit to tap 81 on the inner end of support member 72, and the other end of the conduit is provided with a coupling 116 for connection with the threaded outer end of a tap 118 provided in outer end 76 of support member 72 for delivering air to the nozzle assembly through a passageway in outer end cap 76, not shown, which is aligned with passageway 69 leading into nozzle 28. The extension assembly further includes a socket head cap screw 120 identical to cap screw 24 and by which nozzle assembly 16 is mounted on outer end 76 of support member 72. It is contemplated that support member 72 would have a length of 18 or 24 inches and that the component parts of the extension assembly could be provided in the form of a kit having two support members of different length, two operating rods 78 of different length, and hoses of the same length which would be substantially straight with the longer support member and flexed or curved in connection with the shorter support member.

Referring now to FIG. 5 in conjunction with the foregoing description of FIGS. 1–4, nozzle assembly 16 of the spray gun shown in FIG. 1 is mounted on the gun housing through the use of the extension assembly by removing cap screw 24 to release the nozzle assembly from the housing and then removing the nozzle assembly and valving rod 58 from the housing. Support member 72 and bracket 88 are mounted on the outer end of arm 20 of support member 14 of the spray gun housing by introducing the outer end of arm 20 into recess 75 in the inner end of the support member, positioning leg 98 of bracket 88 on the upper side of arm 20, and then inserting the shank of cap screw 24 through opening 100 in bracket leg 98, the existing opening in arm 20 for the cap screw and into threaded engagement with opening 77 in the bottom wall of recess 75 of support member 72. Operating rod 78 is then introduced through passageways 86 in support and guide components 84 on support member 72 for one end of the operating rod to extend into the gun housing for coupling with the valving rod draw bar therein in the manner described hereinabove with regard to the coupling of inner end 62 of valving rod 58 therewith through mating notches 64 and flats 65 on the valving rod and valving rod draw bar. This coupling arrangement is identical with that between the outer end of operating rod 78 in the inner end of valving rod 58 when nozzle assembly 16 is mounted on the outer end of support member 72, and the latter coupling configuration is shown in FIG. 5A of the drawing. The coupling between the outer end of rod 78 and the inner end of valving rod 58 is within passageway 86 through the outer support and guide member 84, and the length of operating rod 78 is such that operating end 60 of the valving rod extends into the nozzle and valve unit 26 when nozzle assembly 16 is mounted on support member 72 in the same relationship with the nozzle and valve unit as when the latter is mounted directly on arm 20 of the spray gun housing. The nozzle assembly is mounted on the outer end of support member 72 by socket head cap screw 120 which is identical to cap screw 24 by which the nozzle assembly is mounted on arm 20 of the gun housing. When nozzle assembly 16 has been mounted on support member 72, ends 106 of conduits 102 and 104 are respectively connected to inlets 46 and 48 of nozzle and valve unit 26 and ends 108 of the conduits are respectively introduced through openings 92 and 94 in bracket 88 and secured thereto by couplings 110. Mounting of the extension assembly is complete when coupling 116 on air conduit 112 is connected to tap 118 on the outer end of support member 72 and coupling 114 on the inner end of the conduit is connected to tap 81 on the inner end of the support member. When couplings 110 of conduits 102 and 104 are respectively connected to chemical compound supply lines 50 and 52 and coupling 38 on handle 12 is connected to a source of air under pressure, the spray gun is ready for operation. As mentioned hereinabove, when trigger 34 is displaced toward handle 12 operating rod 78 is displaced to the left and FIG. 5 to retract operating end 60 of valving rod 58 from the nozzle and valve unit, whereupon the two chemical components flow into the mixing area in the nozzle and valve unit and are dispensed forwardly of the nozzle in a spray pattern. At the same time, air under pressure flows to nozzle and valve unit 26 and through the outlet 28*a* of nozzle 28 to clean the spray pattern disc and atomize oversize droplets. Upon release of trigger 34, control rod 78 and thus valving rod 58 are displaced to the right in FIG. 5 to shut off the flow of chemical components to the nozzle and valve unit, and operating end 60 of the valving rod pushes residual chemical materials from the nozzle.

Figure 6:
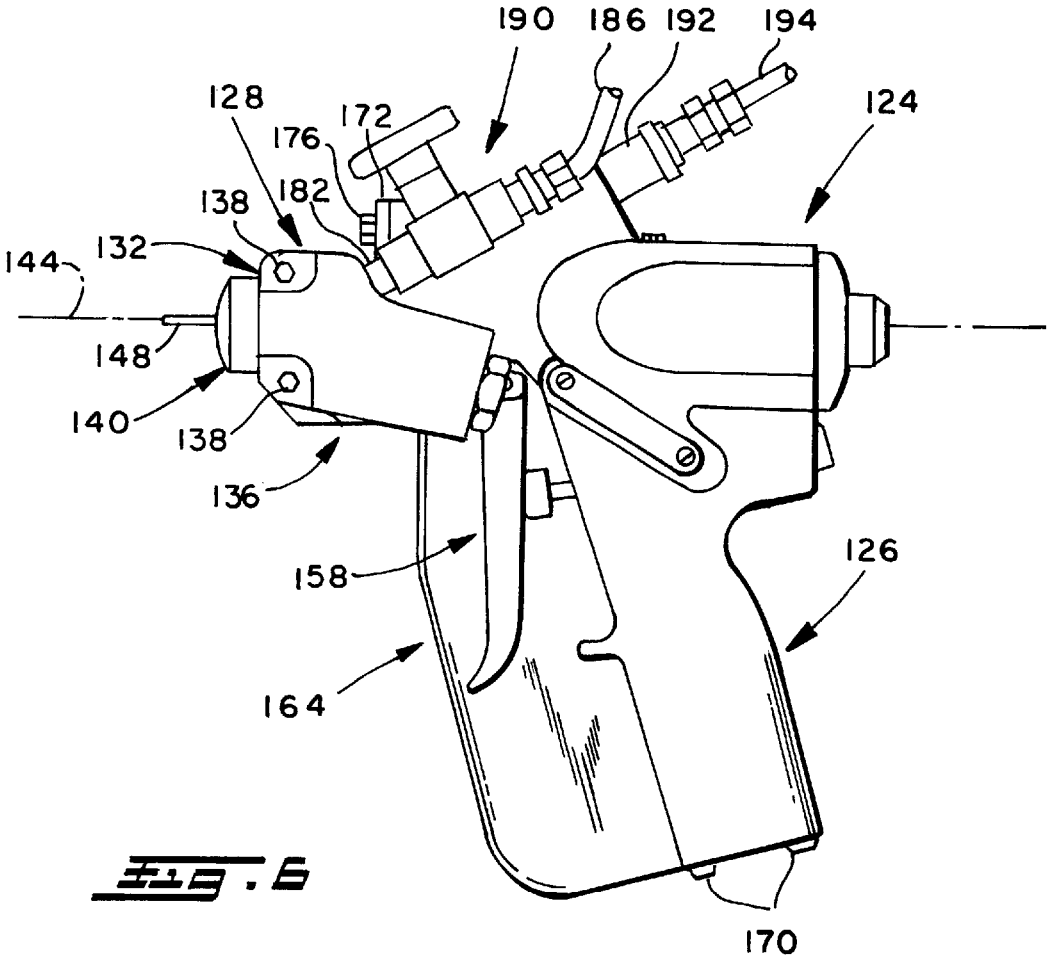
FIG. 6 is a side elevation view of another spray gun for which another embodiment of a nozzle extension is provided in accordance with the present invention.
Figure 7:
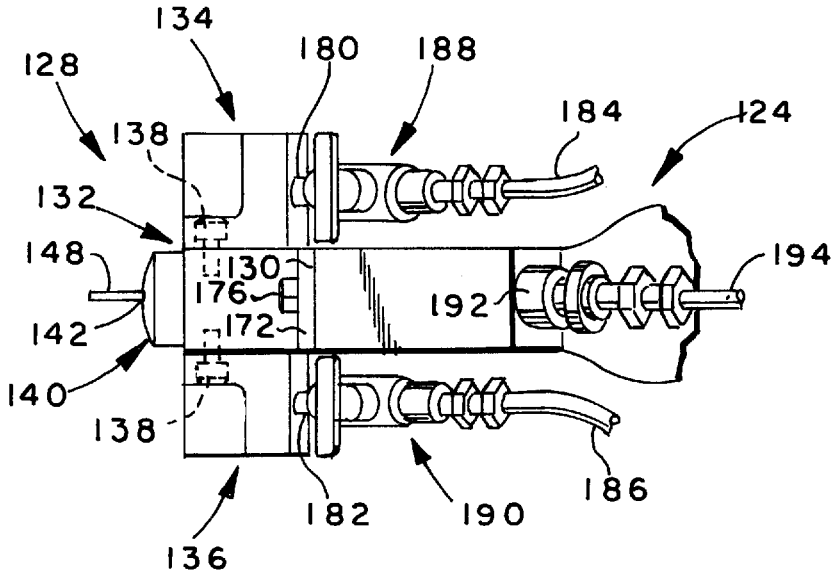
FIG. 7 is a plan view of a portion of the spray gun shown in FIG. 6.
Figure 8:
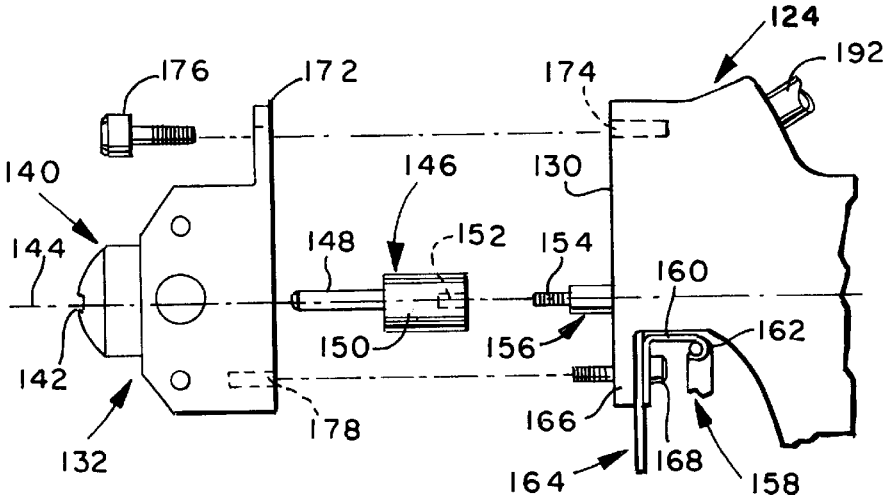
FIG. 8 is an exploded side elevation view of a portion of the spray gun shown in FIG. 6.

FIGS. 6–8 illustrate the Probler spray gun identified hereinabove as being available from Glas-Craft, Inc., and this gun comprises a housing 124 having a handle 126 and a nozzle assembly 128 which is removably mounted on the front end 130 of the housing. More particularly in this respect, nozzle assembly 128 includes a nozzle and valve unit 132 and block members 134 and 136 mounted on laterally opposite sides of the nozzle and valve unit by corresponding socket head cap screws 138. Nozzle and valve unit 132 includes a nozzle 140 having a discharge outlet 142 providing a gun axis 144 and, as best seen in FIG. 8, a valving rod component 146 coaxial with axis 144 and having a cylindrical operating end 148 and a mounting end 150 having a threaded bore 152 in the inner end thereof for connecting the valving rod with the threaded outer end 154 of a valving rod draw bar 156 in gun housing 124. The spray gun further includes a trigger 158 supported on an L-shape bracket 160 for pivotal displacement relative to the gun housing about a pivot pin 162, and bracket 160 together with the upper end of a hand guard 164 are attached to a housing flange 166 at the lower end of front 130 of the housing by a socket head cap screw 168. As set forth hereinafter, the latter also serves in part to removably mount nozzle and valve unit 132 and thus nozzle assembly 128 on housing 124 and, as seen in FIG. 6, the lower end of hand guard 164 is attached to the bottom of handle 126 of the gun housing by fasteners 173. The upper end of nozzle and valve unit 132 is provided with an apertured mounting flange 172 and the upper end of front end 130 of housing 124 is provided with a threaded bore 174 for receiving the threaded shank of a socket head cap screw 176, and the lower end of nozzle and valve unit 132 is provided with a threaded bore 178 for receiving the threaded shank of socket head cap screw 168. Accordingly, as will be best appreciated from FIG. 8, nozzle and valve unit 132 and thus nozzle assembly 128 is removably mounted on front end 130 of gun housing 124 by socket head cap screws 168 and 176.

Block members 134 and 136 have internal chambers, not shown, each connectable to a different one of the two chemical components of the polyurethane foam to be sprayed and which chambers open into a mixing area in nozzle and valve unit 132 in response to displacement of the gun trigger toward handle 126 and the resulting retraction of valving rod 146 relative to the nozzle and valve unit. Block members 134 and 136 are provided with inlet conduits 180 and 182, respectively, for respectively connecting the chambers with chemical component supply lines 184 and 186 across corresponding manual shut-off valves 188 and 190. Gun housing 124 is provided with an air inlet conduit 192 which is adapted to receive air from a source of air under pressure through a supply line 194. As is known with respect to this gun, air under pressure is used to displace the valving rod to achieve mixing and dispensing of the chemical components upon displacement of trigger 158 toward handle 126. Further, the air under pressure is delivered through nozzle outlet 142 to purge chemical components from the nozzle upon the release of the trigger following a spraying operation. When the trigger is displaced toward the gun handle to initiate a spraying operation, the air flow to nozzle 140 is shut-off.

Figure 9:
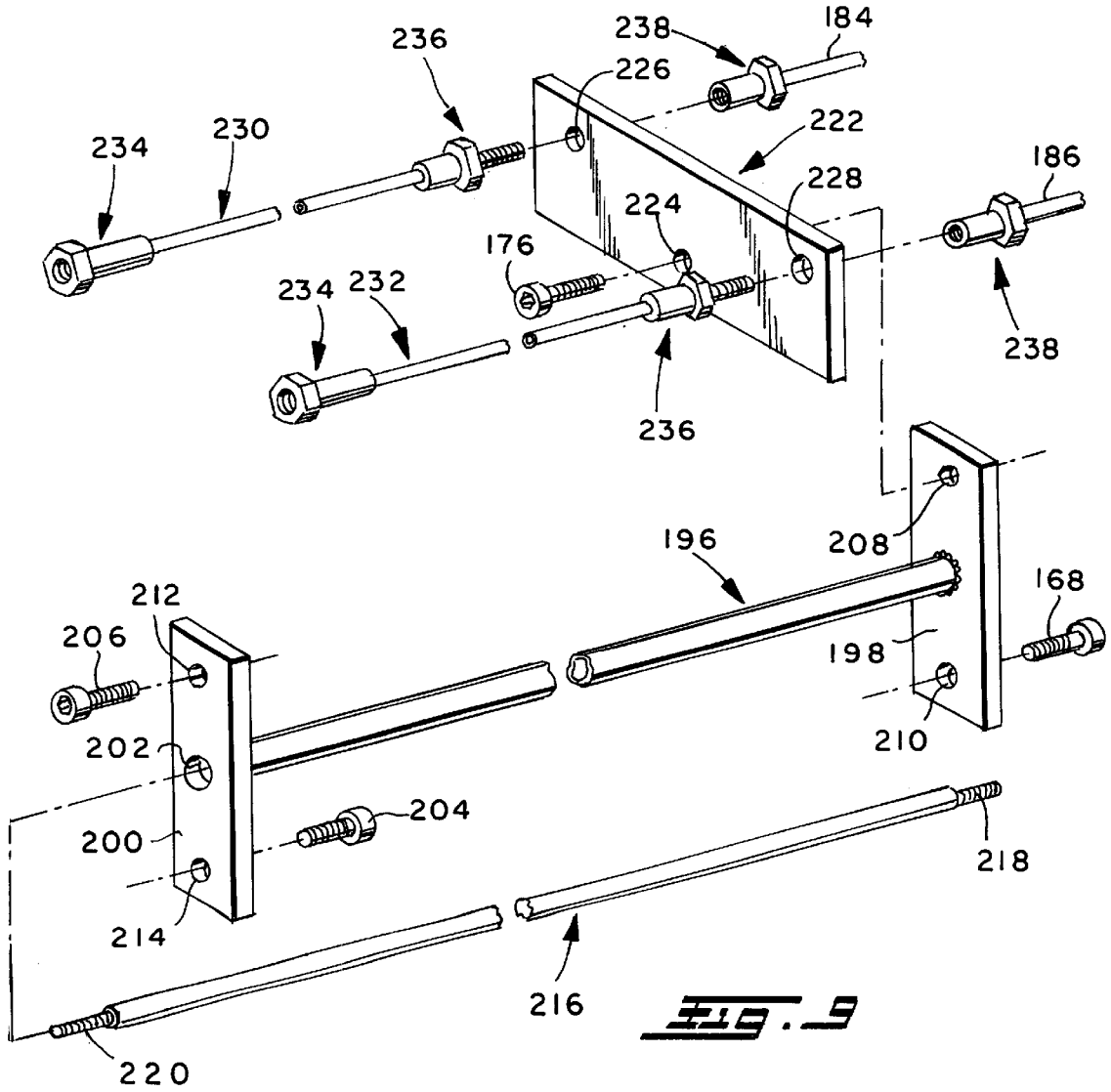
FIG. 9 is an exploded perspective view of the component parts of a nozzle extension assembly for the spray gun shown in FIG. 6–8; and, FIG. 10 is a side elevation view partially in section, showing the extension assembly mounted between the spray gun body and nozzle assembly of the spray gun shown in FIG. 6.
Figure 10:
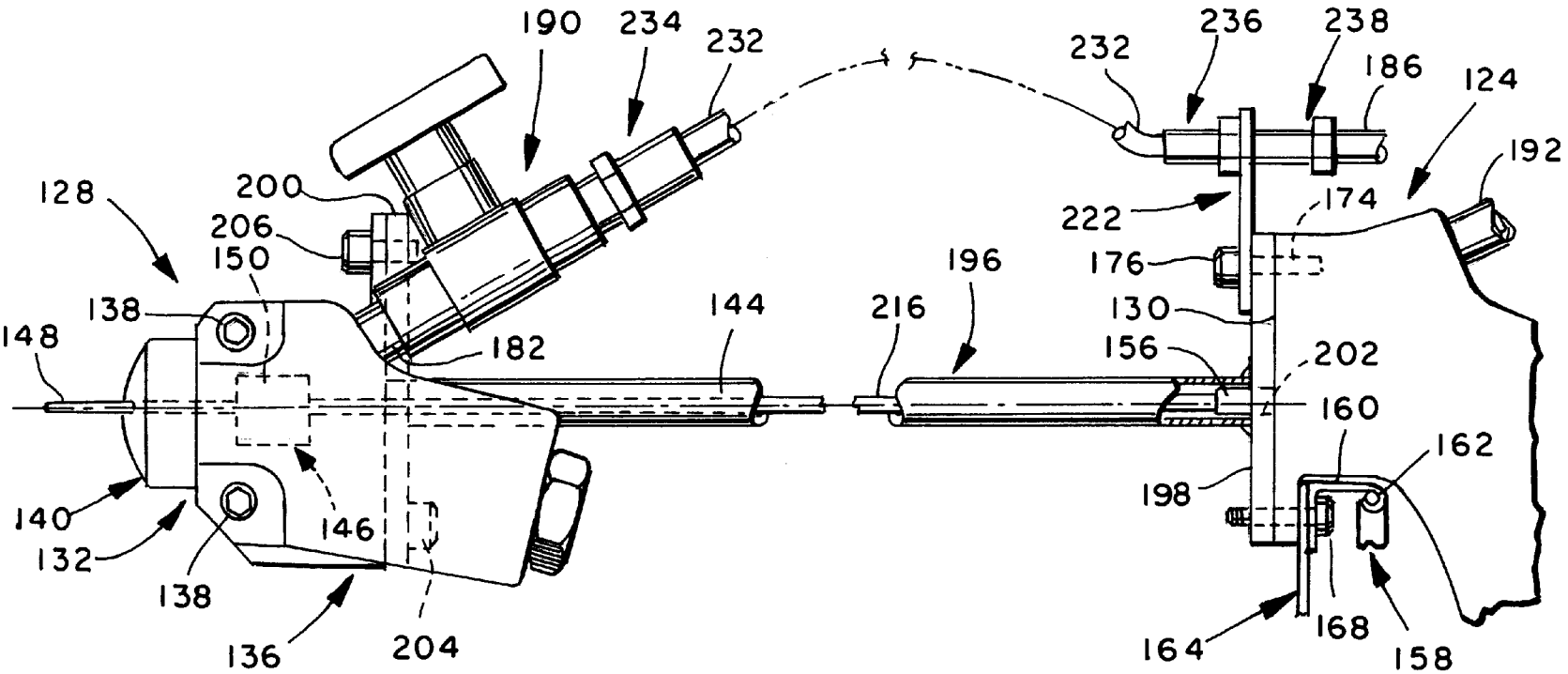

FIG. 9 illustrates the component parts of an extension assembly for the gun shown in FIGS. 6–8 and by which nozzle assembly 128 is adapted to be mounted on gun housing 124 at a location spaced forwardly of front end 130 thereof, and FIG. 10 illustrates the nozzle assembly so mounted. As with the earlier embodiment, the extension assembly can position the nozzle assembly forwardly of the gun housing any desired distance, such as 8 or 24 inches, for example. Referring now to FIG. 9, the extension assembly in this embodiment comprises a tubular support member 196 which, with respect to gun housing 124, has axially inner and outer ends respectively provided with mounting plates 198 and 200 secured thereto such as by welding. As will be appreciated from FIG. 9 with respect to mounting plate 200, each of the mounting plates is provided with an aperture 202 coaxial with and corresponding in diameter to the inner diameter of tubular member 196. Mounting plates 198 and 200 are vertical with respect to the orientation of the spray gun shown in FIGS. 6–8 and with respect to the mounting of the support member between the gun housing and the nozzle assembly. In the manner set forth more fully hereinafter, mounting flange 198 is adapted to be attached to front end 130 of the gun housing using existing cap head screws 168 and 176, and nozzle assembly 128 is adapted to be connected to the axially outer side of mounting plate 200 using cap head screws 204 and 206 which are identical to cap screws 168 and 176. For such attachment, mounting plate 198 is provided with upper and lower mounting apertures 208 and 210, respectively, and mounting plate 200 is provided with upper and lower mounting apertures 212 and 214, respectively. Lower mounting aperture 210 of plate 198 and upper mounting aperture 212 of mounting plate 200 are internally threaded for the reason which will become apparent hereinafter. The extension assembly further includes an operating member 216 in the form of a circular rod having axially inner and outer ends respectively provided with an axially extending internally threaded bore 218 and an axially extending externally threaded stem 220. In this embodiment, operating member 216 is disposed in tubular support member 196 and is supported therein for axial reciprocation relative thereto as described more fully hereinafter. The extension assembly further includes a mounting bracket 222 having a mounting aperture 224 therethrough by which the bracket is mounted on the gun housing as will become apparent hereinafter, and the laterally opposite ends of bracket 122 are provided with openings 226 and 228 for the purpose which will become apparent hereinafter. The extension assembly further includes a pair-of chemical supply conduits 230 and 232 for respectively supplying a chemical component to inlets 180 and 182 of nozzle and valve unit 132, and each of the conduits has a first end 234 provided with a coupling for connection to the corresponding inlet. Each of the conduits has a second end 236 including a coupling component by which the corresponding conduit is adapted to be supported on mounting bracket 222. More particularly in this respect, the latter coupling components have threaded ends adapted to extend through a corresponding one of the openings 226 and 228 and to receive an internally threaded coupling component 238 by which the ends of conduits 230 and 232 are secured to mounting bracket 222 for connection to the corresponding one of the chemical component supply lines 184 and 186. Conduits 230 and 232 are preferably rubber hoses or the like.

Referring now to FIG. 10 in conjunction with the foregoing description of FIGS. 6–9, nozzle assembly 128 of the spray gun shown in FIG. 6 is mounted on the gun housing through the use of the extension assembly by removing cap screws 168 and 176 to release the nozzle assembly from the housing and then removing the nozzle assembly and unscrewing the valving rod from the valving rod draw bar 156. Operating member 216 is introduced into tubular support member 196 prior to mounting the latter on the gun housing, and the axially inner end of the operating member is threadedly interengaged with the valving rod draw bar by introducing threaded stem 54 of the latter into threaded bore 218 in the operating member. Support member 196 and mounting bracket 222 are then mounted on outer end 130 of housing 124 by introducing the shank of cap screw 176 through opening 224 in the mounting bracket and opening 208 in mounting plate 198 and thence into threaded engagement with threaded bore 174 in the housing, and by introducing the threaded shank of cap screw 168 into threaded lower opening 210 in mounting bracket 198. Valving rod 146 is attached to the axially outer end of operating member 216 by threadedly interengaging stem 220 of the latter with threaded bore 152 in the valving rod, and the valving rod is introduced into nozzle and valve unit 132 and the nozzle assembly is then attached to the outer side of mounting plate 200 by threadedly engaging the stem of cap screw 206 with the internally threaded opening 212 in mounting plate 200 and engaging the threaded stem of cap screw 204 with internally threaded bore 178 in the nozzle and valve unit. As will be appreciated from FIG. 10, tubular support member 196 and nozzle component 140 when so mounted are coaxial with gun axis 144. As will be further appreciated from FIG. 10 with respect to supply conduit 232, ends 234 of supply conduits 230 and 232 are respectively connected to inlets 180 and 182 of the nozzle assembly and ends 236 of the conduits are respectively introduced through openings 226 and 228 in bracket 222 and secured thereto by couplings 238. As mentioned hereinabove, air under pressure from inlet 192 flows through housing 124 to nozzle 140 to purge the latter of chemicals following a spraying operation. Accordingly, it will be appreciated that such air under pressure flows through tubular support member 196 to nozzle 140 when the nozzle assembly is mounted on the gun housing by the extension assembly and the trigger is in its released position.

When nozzle assembly 128 is mounted on gun housing 124 through the use of the extension assembly as described hereinabove, displacement of trigger 158 towards handle 126 of the housing operates to initiate air flow to retract valving rod draw bar 156 and thus operating member 216 so as to withdraw valving rod 146 relative to the nozzle assembly, whereupon the two chemical components flow into the mixing area in the nozzle and valve unit 132 and are dispensed forwardly of the nozzle in a spray pattern. Upon release of trigger 158, control rod 216 and thus valving rod 146 are displaced to the left in FIG. 10 to shut-off the flow of chemical components to the nozzle and valve unit, whereupon air under pressure from inlet 192 flows through tubular support member 196 and through nozzle 140 to purge the chemical materials therefrom.

While considerable emphasis has been placed on the preferred embodiments herein illustrated and described and the component parts and the structural interrelationships between the component parts thereof, it will be appreciated that other embodiments can be devised and that many changes can be made in the preferred embodiments without departing from the principals of the present invention. In particular in this respect, it will be appreciated that air flow to the nozzle component in both embodiments herein is preferred but not necessary to operate the spray guns. In this respect, the pattern control disc would have to be manually cleaned periodically and dripping at the nozzle might occur during spraying with the GX-7 gun. While such might affect quality and productivity, it would not preclude use of the gun. Likewise, with respect to the Probler gun, manual cleaning of the nozzle in the absence of an air purge would affect productivity but not operability. Still further, while it might not be practical it would be possible to connect the chemical component supply lines from the sources thereof directly to the inlets of the nozzle assembly when the latter is mounted on the extension assembly and to secure the supply lines in some manner to the gun housing so as to preclude their interfering with manipulation of the gun and extension assembly by an operator during use thereof. These and other changes in the preferred embodiments as well as other embodiments of the extension assemblies will be suggested to those skilled in the art from the disclosure herein. Accordingly, it is to be distinctly understood that the foregoing descriptive matter is to be interpreted merely as illustrative of the invention and not as a limitation.

What is claimed is:

1. An extension assembly for a dispensing gun for dispensing polyurethane foam and comprising a housing, a nozzle assembly removably mounted on said housing and including first and second inlets for connection respectively to sources of first and second chemical components of a polyurethane foam, an outlet for dispensing a mixture of said components, valve means, and actuating means including a trigger on said housing for displacing said valve means to control the flow of the chemical components to and through said outlet, said extension assembly comprising a support member for mounting said nozzle assembly on said housing at a location spaced therefrom, and an actuating member between said actuating means and said nozzle assembly at said location for displacing said valve means to control the flow of the chemical components through said outlet at said location.

2. The extension assembly according to claim 1, wherein said gun further includes an air inlet on said housing for connection to a source of air under pressure and an air outlet in said housing to said nozzle assembly, said extension assembly further including means for connecting said air outlet at said housing with said nozzle assembly at said location.

3. The extension assembly according to claim 1, and further including first and second supply conduits having first ends for connection respectively to said first and second inlets and second ends supported on said housing for connection respectively with the sources of first and second components.

4. The extension assembly according to claim 3, wherein each of said first and second supply conduits includes a flexible hose between said first and second ends thereof.

5. The extension assembly according to claim 1, wherein said support member has a first end removably mountable on said housing and a second end on which said nozzle means is removably mountable.

6. The extension assembly according to claim 5, wherein said actuating member extends along said support member in the direction between said first and second ends thereof.

7. The extension assembly according to claim 6, and means supporting said actuating member on said support member for displacement relative thereto in said direction.

8. The extension assembly according to claim 7, wherein said gun further includes an air inlet on said housing for connection to a source of air under pressure and an air outlet in said housing to said nozzle assembly, said extension assembly further including an air conduit for connecting said air outlet at said housing with said nozzle assembly at said location.

9. The extension assembly according to claim 8, wherein said air conduit includes a flexible hose.

10. The extension assembly according to claim 8, and further including first and second supply conduits having first ends for connection respectively to said first and second inlets and second ends supported on said housing for connection respectively with the sources of first and second components.

11. The extension assembly according to claim 10, wherein each of said first and second supply conduits includes a flexible hose between said first and second ends thereof.

12. The extension assembly according to claim 7, and further including first and second supply conduits having first ends for connection respectively to said first and second inlets and second ends supported on said housing for connection respectively with the sources of first and second components.

13. The extension assembly according to claim 12, wherein each of said first and second supply conduits includes a flexible hose between said first and second ends thereof.

14. The extension assembly according to claim 1, wherein said support member is rigid between said housing and said nozzle assembly and said actuating member includes a rod supported for reciprocation in the direction between said housing and said nozzle assembly.

15. The extension assembly according to claim 14, wherein said support member has first and second ends respectively at said housing and said nozzle assembly and has an axis between said ends, and said rod being supported on said support member parallel to and laterally spaced from said axis.

16. The extension assembly according to claim 15, wherein said gun further includes an air inlet on said housing for connection to a source of air under pressure and an air outlet in said housing to said nozzle assembly, said extension assembly further including an air conduit for connecting said air outlet at said housing with said nozzle assembly at said location.

17. The extension assembly according to claim 16, and further including first and second supply conduits having first ends for connection respectively to said first and second inlets and second ends supported on said housing for connection respectively with the sources of first and second components.

18. The extension assembly according to claim 17, wherein each said first and second supply conduit and said air conduit includes a flexible hose.

19. The extension assembly according to claim 15, and further including first and second supply conduits having first ends for connection respectively to said first and second inlets and second ends supported on said housing for connection respectively with the sources of first and second components.

20. The extension assembly according to claim 19, wherein each of said first and second supply conduits includes a flexible hose between said first and second ends thereof.

21. An extension assembly for a dispensing gun for dispensing polyurethane foam and comprising a housing, a nozzle assembly removably mounted on said housing and including first and second inlets for connection respectively to sources of first and second chemical components of a polyurethane foam, an outlet for dispensing a mixture of said components, valve means, and actuating means including a trigger on said housing for displacing said valve means to control the flow of the chemical components to and through said outlet, said extension assembly comprising a support member for mounting said nozzle assembly on said housing at a location spaced therefrom, and an actuating member between said actuating means and said nozzle assembly at said location for displacing said valve means to control the flow of the chemical components through said outlet at said location, said support member having a first end removably mountable on said housing and a second end on which said nozzle means is removably mountable, said support member including a tubular portion between said first and second ends thereof, and said actuating member extending through said tubular portion.

22. The extension assembly according to claim 21, wherein said gun further includes an air inlet on said housing for connection to a source of air under pressure and an air outlet in said housing to said nozzle assembly, said tubular portion of said support member connecting said air outlet at said housing with said nozzle assembly at said location.

23. The extension assembly according to claim 22, and further including first and second supply conduits having first ends for connection respectively to said first and second inlets and second ends supported on said housing for connection respectively with the sources of first and second components.

24. The extension assembly according to claim 21, and further including first and second supply conduits having first ends for connection respectively to said first and second inlets and second ends supported on said housing for connection respectively with the sources of first and second components.

25. The extension assembly according to claim 24, wherein each of said first and second supply conduits includes a flexible hose between said first and second ends thereof.

26. An extension assembly for a dispensing gun for dispensing polyurethane foam and comprising a housing, a nozzle assembly removably mounted on said housing and including first and second inlets for connection respectively to sources of first and second chemical components of a polyurethane foam, an outlet for dispensing a mixture of said components, valve means, and actuating means including a trigger on said housing for displacing said valve means to control the flow of the chemical components to and through said outlet, said extension assembly comprising a support member for mounting said nozzle assembly on said housing at a location spaced therefrom, and an actuating member between said actuating means and said nozzle assembly at said location for displacing said valve means to control the flow of the chemical components through said outlet at said location, said support member being rigid between said housing and said nozzle assembly, said actuating member including a rod supported for reciprocation in the direction between said housing and said nozzle assembly, said support member having first and second ends respectively at said housing and said nozzle assembly and including a tubular portion between said ends, and said rod extending through said tubular portion.

27. The extension assembly according to claim 26, wherein said gun further includes an air inlet on said housing for connection to a source of air under pressure and an air outlet in said housing to said nozzle assembly, said tubular portion of said support member connecting said air outlet at said housing with said nozzle assembly at said location.

28. The extension assembly according to claim 27, and further including first and second supply conduits having first ends for connection respectively to said first and second inlets and second ends supported on said housing for connection respectively with the sources of first and second components.

29. The extension assembly according to claim 28, wherein each of said first and second supply conduits includes a flexible hose between said first and second ends thereof.

30. The extension assembly according to claim 26, and further including first and second supply conduits having first ends for connection respectively to said first and second inlets and second ends supported on said housing connection respectively with the sources of first and second components.

31. The extension assembly according to claim 30, wherein each of said first and second supply conduits includes a flexible hose between said first and second ends thereof.

* * * * *